US006170093B1

(12) United States Patent
Kowalski

(10) Patent No.: US 6,170,093 B1
(45) Date of Patent: Jan. 9, 2001

(54) RETRACTABLE PLATFORM FOR SWIMMING POOL

(76) Inventor: Paul D. Kowalski, 9260 Roll Rd., Clarence Center, NY (US) 14032

( * ) Notice: Under 35 U.S.C. 154(b), the term of this patent shall be extended for 0 days.

(21) Appl. No.: 09/488,983

(22) Filed: Jan. 21, 2000

(51) Int. Cl.[7] ..... E04H 4/00
(52) U.S. Cl. ..... 4/496; 4/573.1
(58) Field of Search ..... 4/494, 496, 560.1, 4/573.1, 578.1, 579; 114/362; 182/97

(56) References Cited

U.S. PATENT DOCUMENTS

| | | | | |
|---|---|---|---|---|
| D. 253,999 | | 1/1980 | Richards et al. | 114/362 |
| 2,965,153 | * | 12/1960 | Purcell, Sr. | 4/578.1 X |
| 4,237,661 | * | 12/1980 | Adams, Sr. et al. | 4/496 X |
| 4,462,485 | * | 7/1984 | Terry et al. | 114/362 X |
| 4,495,883 | | 1/1985 | Hoy | 114/362 |
| 4,799,447 | | 1/1989 | Herbert et al. | 114/362 |
| 4,972,540 | | 11/1990 | Phelps | 14/75 |
| 5,044,465 | * | 9/1991 | Rinke | 182/97 |
| 5,515,806 | | 5/1996 | Mccabe | 114/362 |
| 5,632,224 | | 5/1997 | Schneider | 114/362 |

* cited by examiner

*Primary Examiner*—Robert M. Fetsuga

(57) ABSTRACT

A retractable platform for a swimming pool for preventing damage to the decks, liners and wall of the swimming pool when pets and people alike are entering and exiting the swimming pool. The retractable platform for a swimming pool includes a pair of bracket members adapted to being securely mounted to a deck of a swimming pool; and also includes a pair of cantilever members hingedly attached to the bracket members and being extendable over the swimming pool; and further includes a plurality of platform support members securely attached to and suspended from the cantilever members; and also includes a platform member which securely attached to the platform support members; and further includes a plurality of brace members which are securely attached to the platform support members; and also includes a step member securely attached to two of the platform support members and being spaced above the platform member; and further includes a plurality of fastening members for preventing the cantilever members from uncontrolled pivoting about the bracket members.

11 Claims, 2 Drawing Sheets

RETRACTABLE PLATFORM FOR SWIMMING POOL

BACKGROUND OF THE INVENTION

1. Field of the Invention

The present invention relates to pup deck and more particularly pertains to a new retractable platform for a swimming pool for preventing damage to the decks, liners and wall of the swimming pool when pets and people alike are entering and exiting the swimming pool.

2. Description of the Prior Art

The use of pup deck is known in the prior art. More specifically, pup deck heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,515,806; U.S. Pat. No. 4,799,447; U.S. Pat. No. 5,632,224; U.S. Pat. No. 4,972,540; U.S. Pat. No. 4,495,883; and U.S. Pat. No. Des. 253,999.

While these devices fulfill their respective, particular objectives and requirements, the aforementioned patents do not disclose a new retractable platform for a swimming pool. The inventive device includes a pair of bracket members adapted to being securely mounted to a deck of a swimming pool; and also includes a pair of cantilever members hingedly attached to the bracket members and being extendable over the swimming pool; and further includes a plurality of platform support members securely attached to and suspended from the cantilever members; and also includes a platform member which securely attached to the platform support members; and further includes a plurality of brace members which are securely attached to the platform support members; and also includes a step member securely attached to two of the platform support members and being spaced above the platform member; and further includes a plurality of fastening members for preventing the cantilever members from uncontrolled pivoting about the bracket members.

In these respects, the retractable platform for a swimming pool according to the present invention substantially departs from the conventional concepts and designs of the prior art, and in so doing provides an apparatus primarily developed for the purpose of preventing damage to the decks, liners and wall of the swimming pool when pets and people alike are entering and exiting the swimming pool.

SUMMARY OF THE INVENTION

In view of the foregoing disadvantages inherent in the known types of pup deck now present in the prior art, the present invention provides a new retractable platform for a swimming pool construction wherein the same can be utilized for preventing damage to the decks, liners and wall of the swimming pool when pets and people alike are entering and exiting the swimming pool.

The general purpose of the present invention, which will be described subsequently in greater detail, is to provide a new retractable platform for a swimming pool apparatus and method which has many of the advantages of the pup deck mentioned heretofore and many novel features that result in a new retractable platform for a swimming pool which is not anticipated, rendered obvious, suggested, or even implied by any of the prior art pup deck, either alone or in any combination thereof.

To attain this, the present invention generally comprises a pair of bracket members adapted to being securely mounted to a deck of a swimming pool; and also includes a pair of cantilever members hingedly attached to the bracket members and being extendable over the swimming pool; and further includes a plurality of platform support members securely attached to and suspended from the cantilever members; and also includes a platform member which securely attached to the platform support members; and further includes a plurality of brace members which are securely attached to the platform support members; and also includes a step member securely attached to two of the platform support members and being spaced above the platform member; and further includes a plurality of fastening members for preventing the cantilever members from uncontrolled pivoting about the bracket members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retractable platform for a swimming pool apparatus and method which has many of the advantages of the pup deck mentioned heretofore and many novel features that result in a new retractable platform for a swimming pool which is not anticipated, rendered obvious, suggested, or even implied by any of the prior art pup deck, either alone or in any combination thereof.

It is another object of the present invention to provide a new retractable platform for a swimming pool which may be easily and efficiently manufactured and marketed.

It is a further object of the present invention to provide a new retractable platform for a swimming pool which is of a durable and reliable construction.

An even further object of the present invention is to provide a new retractable platform for a swimming pool which is susceptible of a low cost of manufacture with regard to both materials and labor, and which accordingly is then susceptible of low prices of sale to the consuming public, thereby making such retractable platform for a swimming pool economically available to the buying public.

Still yet another object of the present invention is to provide a new retractable platform for a swimming pool which provides in the apparatuses and methods of the prior art some of the advantages thereof, while simultaneously overcoming some of the disadvantages normally associated therewith.

Still another object of the present invention is to provide a new retractable platform for a swimming pool for preventing damage to the decks, liners and wall of the swimming pool when pets and people alike are entering and exiting the swimming pool.

Yet another object of the present invention is to provide a new retractable platform for a swimming pool which includes a pair of bracket members adapted to being securely mounted to a deck of a swimming pool; and also includes a pair of cantilever members hingedly attached to the bracket members and being extendable over the swimming pool; and further includes a plurality of platform support members securely attached to and suspended from the cantilever members; and also includes a platform member which securely attached to the platform support members; and further includes a plurality of brace members which are securely attached to the platform support members; and also includes a step member securely attached to two of the platform support members and being spaced above the platform member; and further includes a plurality of fastening members for preventing the cantilever members from uncontrolled pivoting about the bracket members.

Still yet another object of the present invention is to provide a new retractable platform for a swimming pool that allows pets and people to easily and conveniently enter and exit a swimming pool.

Even still another object of the present invention is to provide a new retractable platform for a swimming pool that allows pets and certain physically disabled people access to a swimming pool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
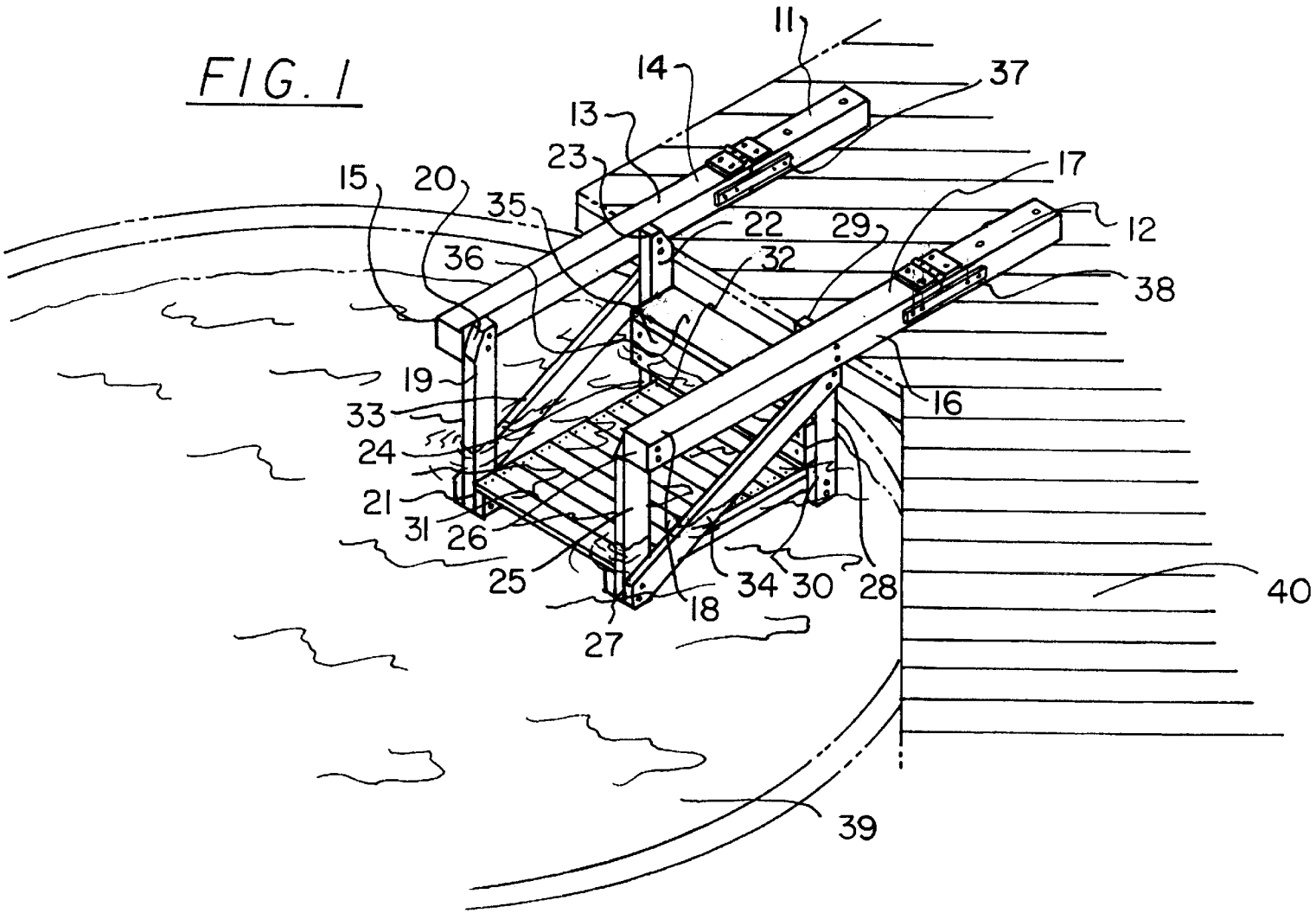
FIG. 1 is a perspective view of a new retractable platform for a swimming pool according to the present invention and being mounted to a deck of a swimming pool.
Figure 2:
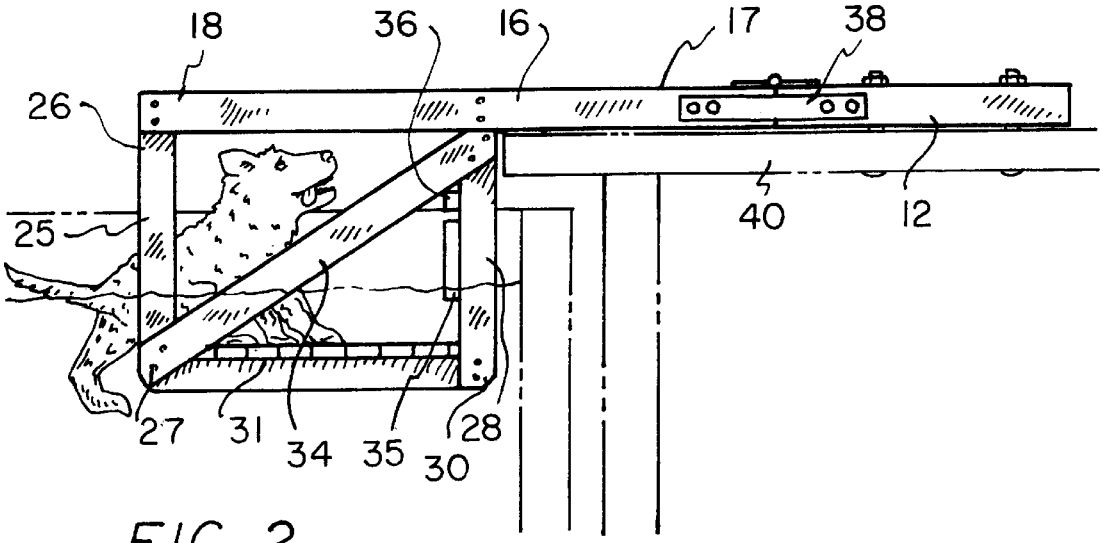
FIG. 2 is a side elevational view of the present invention being used.
Figure 3:
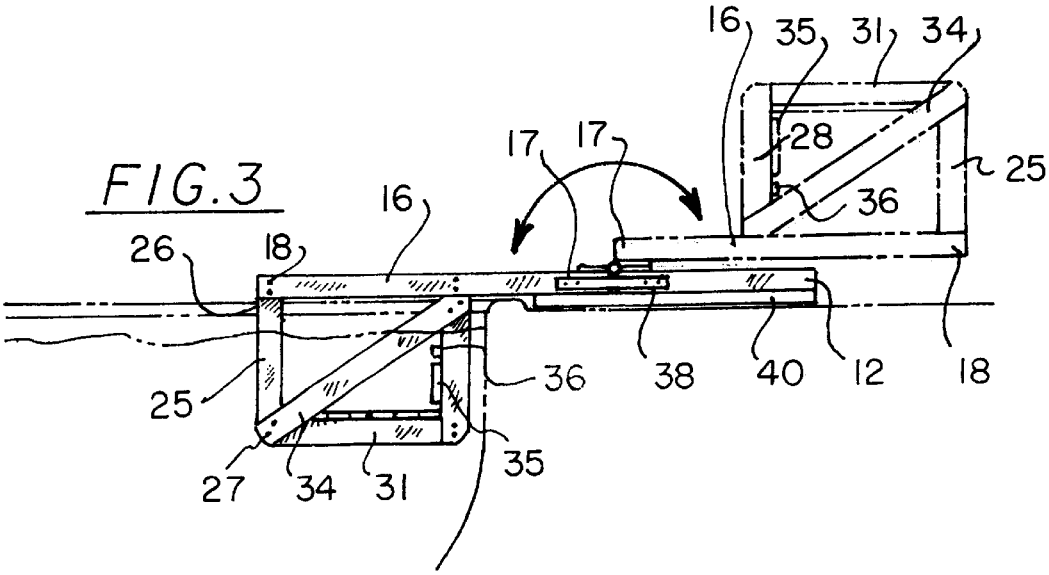
FIG. 3 is a side elevational view of the present invention showing how the platform member can be easily and conveniently removed from the swimming pool.

With reference now to the drawings, and in particular to FIGS. 1 through 3 thereof, a new retractable platform for a swimming pool embodying the principles and concepts of the present invention and generally designated by the reference numeral 10 will be described.

As best illustrated in FIGS. 1 through 3, the retractable platform for a swimming pool 10 generally comprises a pair of bracket members 11,12 adapted to be securely and conventionally mounted with fasteners to a deck 40 of a swimming pool 39; and also comprises a pair of cantilever members 13,16 each having a first end 14,17 which is hingedly attached to a respective one of the bracket members 11,12. The cantilever members 13,16 are spaced apart from one another with each cantilever member 13,16having a second end portion which is adapted to extend over a swimming pool 39. The retractable platform 10 further comprises a plurality of elongate platform support members 19,22,25,28 a first two 19,22 of which are securely and conventionally attached with fasteners to a first one 13 of the cantilever members and are suspended therefrom and a second two 25,28 of which are securely and conventionally attached with fasteners to a second one 16 of the cantilever members and are suspended therefrom. Each of the platform support members 19,22,25,28 has a top end 20,23,26,29 which is securely attached with fasteners to a respective one of the cantilever members 13,16. A first one 19 of the first two platform support members is securely attached with fasteners at a second end 15 of the first one 13 of the cantilever members, and a second one 22 of the first two platform support members is securely attached with fasteners at an intermediate portion of the first one 13 of the cantilever members and are spaced from the first one 19 of the first two platform support members 19,22. A first one 25 of the second two platform support members 25,28 is securely attached with fasteners at a second end 18 of the second one 16 of the cantilever members, and a second one 28 of the second two platform support members 25,28 is securely attached with fasteners at an intermediate portion of the second one 16 of the cantilever members and are spaced from the first one 25 of the second two platform support members 25,28. Each of the platform support members 19,22,25,28 has a length of approximately 26 inches. A platform member 31 is securely attached with fasteners to the platform support members 19,22,25,28, and is securely disposed between the platform support members 19,22,25, 28 and is adapted to be disposed below a surface of water in the swimming pool 39 when the retractable platform 10 is lowered into the swimming pool 39. The platform member 31 includes sides, a front end, and a back end 32 with the platform support members 19,22,25,28 having bottom ends 21,24,27,30 which are securely attached to the sides of the platform member 31. The second one 22 of the first two platform support members 19,22 and the second one 28 of the second two platform support members 25,28 are securely and opposedly attached with fasteners to the sides at the back end 32 of the platform member 31. The platform member 31 has a width of approximately 39 inches. A plurality of brace members 33,34,35 are securely attached with fasteners to the platform support members 19,22,25,28. The brace members 33,34,35 include a first one 33 of the brace members which is securely attached to and interconnects the first two 19,22 of the platform support members, and further includes a second one 34 of the brace members which is securely attached to and interconnects the second two 25,28 of the platform support members, and also includes a third one 35 of the brace members which is securely attached to and interconnects the second one 22 of the first two platform support members and the second one 28 of the second two platform support members. A step member 36 is securely attached with fasteners to two of the platform support members 22,28 and is disposed above the platform member 31 with the step member 36 being securely attached to intermediate portions of the second one 22 of the first two platform support members and the second one 28 of the second two platform support members. The step member 36 is overhangingly disposed above the third one 35 of the brace members. A plurality of fastening members 37,38 are securely attached to where the cantilever members 13,16 are hingedly attached to the bracket members 11,12 to prevent uncontrolled pivoting of the cantilever members 13,16. Each of the fastening members 37,38 includes a metal strap being securely and removably attached to a respective cantilever member 13,16 and a respective bracket member 11,12.

In use, the user lowers the platform member 31 into the swimming pool 39 by swinging the cantilever members 13,16 about the bracket members 11,12 such that the platform member 31 is disposed about six inches below the surface of the water in the swimming pool 39 to allow animals and people alike to enter and exit the swimming pool 39 by climbing upon the platform member 31 and the step member and then upon the deck of the swimming pool 39. When finished, the user can remove the platform member 31 from the swimming pool 39 by swinging the cantilever members 13,16 upwardly and upon the deck 40 of the swimming pool 39 and upon the bracket members 11,12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retractable platform for a swimming pool comprising:

a pair of bracket members adapted to be securely mounted to a deck of a swimming pool;

a pair of cantilever members each having a first end which is hingedly attached to a respective one of said bracket members, said cantilever members being spaced apart from one another and each having a second end portion which is adapted to extend above a swimming pool;

a plurality of elongate platform support members a first two of which are securely attached to a first one of said cantilever members and are suspended therefrom and a second two of which are securely attached to a second one of said cantilever members and are suspended therefrom;

a platform member being securely attached to said platform support members;

a plurality of brace members securely attached to said platform support members;

a step member securely attached to two of said platform support members and being disposed above said platform member; and a plurality of fastening members securely attached to where said cantilever members are hingedly attached to said bracket members to prevent uncontrolled pivoting of said cantilever members.

2. A retractable platform for a swimming pool as described in claim 1, wherein said each of said platform support members have a top end which is securely attached to a respective one of said cantilever members, and further has a bottom end to which said platform member is securely attached.

3. A retractable platform for a swimming pool as described in claim 2, wherein a first one of said first two platform support members is securely attached at a second end of said first one of said cantilever members, and a second one of said first two platform support members is securely attached at an intermediate portion of said first one of said cantilever members and is spaced from said first one of said first two platform support members.

4. A retractable platform for a swimming pool as described in claim 3, wherein a first one of said second two platform support members is securely attached at a second end of said second one of said cantilever members, and a second one of said second two platform support members is securely attached at an intermediate portion of said second one of said cantilever members and is spaced from said first one of said second two platform support members.

5. A retractable platform for a swimming pool as described in claim 4, wherein said platform member is securely disposed between said platform support members and is adapted to be disposed below a surface of water in the swimming pool when said retractable platform is lowered into the swimming pool.

6. A retractable platform for a swimming pool as described in claim 5, wherein said platform member includes sides, a front end, and a back end, said platform support members being securely attached to said sides of said platform member.

7. A retractable platform for a swimming pool as described in claim 6, wherein said second one of said first two platform support members and said second one of said second two platform support members are securely and opposedly attached to said sides at said back end of said platform member.

8. A retractable platform for a swimming pool as described in claim 7, wherein said brace members includes a first one of said brace members which is securely attached to and interconnects said first two of said platform support members, and further includes a second one of said brace members which is securely attached to and interconnects said second two of said platform support members, and also includes a third one of said brace members which is securely attached to and interconnects said second one of said first two platform support members and said second one of said second two platform support members.

9. A retractable platform for a swimming pool as described in claim 8, wherein said step member is securely attached to intermediate portions of said second one of said first two platform support members and said second one of said second two platform support members, said step member being overhangingly disposed above said third one of said brace members.

10. A retractable platform for a swimming pool as described in claim 9, wherein each of said fastening members is a metal strap being securely and removably attached to a respective said cantilever member and a respective said bracket member.

11. A retractable platform for a swimming pool comprising:

a pair of bracket members adapted to be securely mounted to a deck of a swimming pool;

a pair of cantilever members each having a first end which is hingedly attached to a respective one of said bracket members, said cantilever members being spaced apart from one another and each having a second end portion which is adapted to extend above a swimming pool;

a plurality of elongate platform support members a first two of which are securely attached to a first one of said cantilever members and are suspended therefrom and a second two of which are securely attached to a second one of said cantilever members and are suspended therefrom, said each of said platform support members having a top end which is securely attached to a respective one of said cantilever members, a first one of said first two platform support members being securely attached at a second end of said first one of said cantilever members, and a second one of said first two platform support members being securely attached at an intermediate portion of said first one of said cantilever members and being spaced from said first one of said first two platform support members, a first one of said second two platform support members being securely attached at a second end of said second one of said cantilever members, and a second one of said second two platform support members being securely attached at an intermediate portion of said second one of said cantilever members and being spaced from said first one of said second two platform support members, each of said platform support members having a length of approximately 26 inches;

a platform member being securely attached to said platform support members, said platform member being securely disposed between said platform support members and being adapted to be disposed below a surface of water in the swimming pool when said retractable platform is lowered into the swimming pool, said platform member including sides, a front end, and a back end, said platform support members having bottom ends which are securely attached to said sides of said platform member, said second one of said first two platform support members and said second one of said second two platform support members being securely and opposedly attached to said sides at said back end of said platform member, said platform having a width of approximately 39 inches;

a plurality of brace members securely attached to said platform support members, said brace members including a first one of said brace members which is securely attached to and interconnects said first two of said platform support members, and further including a second one of said brace members which is securely attached to and interconnects said second two of said platform support members, and also including a third one of said brace members which is securely attached to and interconnects said second one of said first two platform support members and said second one of said second two platform support members;

a step member securely attached to two of said platform support members and being disposed above said platform member, said step member being securely attached to intermediate portions of said second one of said first two platform support members and said second one of said second two platform support members, said step member being overhangingly disposed above said third one of said brace members; and a plurality of fastening members securely attached to where said cantilever members are hingedly attached to said bracket members to prevent uncontrolled pivoting of said cantilever members, each of said fastening members being a metal strap being securely and removably attached to a respective said cantilever member and a respective said bracket member.

* * * * *